US011234512B2

(12) United States Patent
Sobolewski et al.

(10) Patent No.: US 11,234,512 B2
(45) Date of Patent: Feb. 1, 2022

(54) CUPBOARD OR HOUSEHOLD APPLIANCE AND METHOD FOR OPENING AND CLOSING A CUPBOARD OR HOUSEHOLD APPLIANCE

(71) Applicant: HETTICH HOLDING GMBH & CO. OHG, Kirchlengern (DE)

(72) Inventors: Uwe Sobolewski, Bunde (DE); Stefan Andschus, Lubbecke (DE)

(73) Assignee: HETTICH HOLDING GMBH & CO. OHG, Kirchlengern (DE)

( * ) Notice: Subject to any disclaimer, the term of this patent is extended or adjusted under 35 U.S.C. 154(b) by 0 days.

(21) Appl. No.: 16/489,430

(22) PCT Filed: Feb. 19, 2018

(86) PCT No.: PCT/EP2018/054013
§ 371 (c)(1),
(2) Date: Aug. 28, 2019

(87) PCT Pub. No.: WO2018/158100
PCT Pub. Date: Sep. 7, 2018

(65) Prior Publication Data

US 2019/0380487 A1 Dec. 19, 2019

(30) Foreign Application Priority Data

Mar. 2, 2017 (DE) ..... 102017104336.5

(51) Int. Cl.
*A47B 46/00* (2006.01)
*A47B 81/00* (2006.01)
(Continued)

(52) U.S. Cl.
CPC ..... *A47B 77/04* (2013.01); *A47B 51/00* (2013.01); *E05D 7/0027* (2013.01); *E05D 11/06* (2013.01);
(Continued)

(58) Field of Classification Search
CPC ..... A47B 77/04; A47B 51/00; A47B 96/16; E05D 7/0027; E05D 11/06;
(Continued)

(56) References Cited

U.S. PATENT DOCUMENTS 333,622 A * 1/1886 Garmin ..... E05D 7/0027 16/248
806,277 A * 12/1905 Mckee ..... A47G 29/1216 248/128
(Continued)

FOREIGN PATENT DOCUMENTS

DE 3215572 10/1983
DE 20315920 U1 2/2004
(Continued)

OTHER PUBLICATIONS

Search Report issued in Int'l App. No. PCT/EP2018/054013 (2018).
Examination Report issued in German Patent Application No. 18708066.8 (dated Sep. 7, 2020).

*Primary Examiner* — Kimberley S Wright
(74) *Attorney, Agent, or Firm* — Barnes & Thornburg LLP

(57) ABSTRACT

The disclosure relates to a cupboard or household appliance, particularly a wall-mounted cupboard, comprising a carcass on which a door can be pivoted from a closed position into an open position by means of a pivoting device, at least one holder for storing objects being attached to an inner side of the door facing the carcass, the door being lowerable down a guiding device, in an open range of the door. The invention further relates to a method for opening and closing a cupboard or a household appliance.

14 Claims, 18 Drawing Sheets

(51) Int. Cl.

| | |
|---|---|
| ***A47B 77/04*** | (2006.01) |
| ***E05D 7/00*** | (2006.01) |
| ***E05D 11/06*** | (2006.01) |
| ***A47B 51/00*** | (2006.01) |
| *E05D 15/58* | (2006.01) |

(52) U.S. Cl.
CPC ..... *E05D 2015/586* (2013.01); *E05Y 2900/20* (2013.01)

(58) Field of Classification Search
CPC ..... E05D 2015/58; E05D 2015/586; E05D 2015/22; E06B 3/5009; E06B 3/5045; E06B 3/5054; E06B 3/5081; E06B 3/509
See application file for complete search history.

(56) References Cited

U.S. PATENT DOCUMENTS 1,253,655 A * 1/1918 Weiderrecht ..... E05D 7/0027 16/248
1,255,291 A * 2/1918 chalfant ..... E05D 7/0027 16/248
1,720,050 A * 7/1929 Morris ..... E06B 3/5045 312/110
3,078,133 A 2/1963 Schauer
3,081,138 A 3/1963 Stebbins
3,099,866 A * 8/1963 Matranga ..... E06B 3/50 49/162
3,101,982 A * 8/1963 Dosmar ..... A47B 51/00 312/312
3,172,715 A * 3/1965 Powder ..... F25D 25/027 312/298
3,224,827 A * 12/1965 Foster ..... A47B 46/005 312/266
4,403,449 A * 9/1983 Richmond ..... E05F 15/63 403/323
4,639,051 A * 1/1987 DeBruyn ..... A47B 96/16 312/275
4,783,131 A * 11/1988 Grass ..... E05D 15/44 312/276
5,228,763 A * 7/1993 Gingold ..... A47B 46/005 312/247
5,330,261 A * 7/1994 Bennett ..... A47F 3/0486 211/88.01
6,318,824 B1 * 11/2001 LaGrotta ..... E05D 3/022 312/322
7,770,986 B1 8/2010 Simaitis
8,083,303 B2 * 12/2011 Compagnucci ..... A47B 81/002 312/322
8,231,187 B2 * 7/2012 Hoffman ..... E05D 15/58 312/322
8,245,445 B2 * 8/2012 Palacios ..... E05D 15/20 49/128
8,911,035 B2 * 12/2014 Kopnick ..... A47B 81/002 312/238
8,966,713 B1 * 3/2015 Russo ..... E05D 7/0009 16/285
9,284,761 B2 * 3/2016 Haab ..... E05D 15/58
9,474,372 B2 * 10/2016 Herper ..... A47B 88/483
9,677,317 B2 * 6/2017 Daniel-Wayman ... E05F 15/616
2006/0255697 A1 * 11/2006 Smieszek ..... E06B 3/5045 312/21
2007/0159037 A1 * 7/2007 Hoffman ..... E05D 15/58 312/322
2009/0289535 A1 * 11/2009 Weber ..... A47B 51/00 312/317.1
2010/0223853 A1 * 9/2010 Daniel-Wayman ... E05F 15/616 49/358
2011/0266936 A1 11/2011 Moran
2012/0049708 A1 * 3/2012 Kopnick ..... A47B 81/002 312/238
2016/0073781 A1 * 3/2016 Herper ..... A47B 88/483 312/334.1
2019/0077233 A1 * 3/2019 Ma ..... B60J 5/0488

FOREIGN PATENT DOCUMENTS

DE 202005006019 U1 11/2005
JP H02-116839 U 9/1990
JP 04-027384 Y2 * 7/1992
JP 2523904 Y2 1/1997
JP 2015-36003 2/2015

* cited by examiner

CUPBOARD OR HOUSEHOLD APPLIANCE AND METHOD FOR OPENING AND CLOSING A CUPBOARD OR HOUSEHOLD APPLIANCE

CROSS-REFERENCE TO RELATED APPLICATIONS

This application is a U.S. nationalization under 35 U.S.C. § 371 of International Application No. PCT/EP2018/054013, filed Feb. 19, 2018, which claims priority to German Patent Application No. 102017104336.5, filed Mar. 2, 2017. The disclosures set forth in the referenced applications are incorporated herein by reference in their entireties.

BACKGROUND AND SUMMARY OF THE DISCLOSURE

The present disclosure is directed to a cupboard or household appliance, in particular as a hanging cabinet, having a body, on which a door is pivotable via a pivot device from a closed position into an open position, wherein at least one holder for storing objects is fixed on an inner side of the door facing toward the body, and a method for opening and closing a cupboard or household appliance.

DE 32 155 72 A1 discloses a wall unit having a lowerable insert basket which is guided in vertical guide grooves and is lowerable and raisable by means of gearing. The problem is solved by such a wall unit that the upper compartments of a wall unit are poorly accessible and access can take place more easily after the lowering. However, it is problematic in the case of such a wall unit that the region below the wall unit has to be free so that it does not collide with the lowerable insert basket. Moreover, large weight loads have to be moved in the case of a drive, since in particular in the lower compartments of a wall unit, heavy objects such as glasses or plates are frequently stored, to which a frequent access is necessary.

The present disclosure is directed to a cupboard or household appliance and a method for opening and closing a cupboard or household appliance, wherein storage space in a cupboard or household appliance can be better used in particular in the upper region.

In a cupboard or household appliance according to the disclosure, a door is pivotable relative to the body and can thus be pivoted from a closed position into a first open position. This first open position is located in an opening range of the door, and the door can be lowered downward along a guide device in the opening range. At least one holder for storing objects can thus be moved into the access range of a user, who can then remove or return objects from or to the holder. Subsequently, the door can be raised again via the guide device and pivoted from the opening range into a closed position. This enables an effective utilization of an upper region of a cupboard or household appliance, which is otherwise poorly accessible, for example, because the upper region is no longer in the access range of a person.

The guide device is preferably designed as a linear guide. The linear guide can comprise one or more rails in this case, which are movable relative to one another. Alternatively, only one guide rail can also be provided, along which a carriage is movable via roller bodies or rollers to enable a linear movement of the door in the vertical direction.

According to one preferred embodiment, a first blocking device is provided, which prevents lowering of the door in a closing range of the door. The door having the holder on an inner side firstly has to reach a predetermined open position to prevent striking of the holder on the body or on a shelf in the body. The first blocking device can prevent lowering of the door to avoid such striking at least in a closing range between the closed position and an opening angle of 60°, in particular up to a range of 70°. A second blocking device can preferably also be provided, which prevents pivoting of the door in a closing range when the door is located in a lowered position. Such a blocking device can be formed via mechanical means, for example, a stop bracket, but also electronic control means can be used as the blocking device.

The door may be pre-tensioned in a raised position via a force accumulator. Spring elements, in particular gas pressure springs or other springs, can be used as force accumulators, or counterweights, which are coupled via connecting means to the door, so that the counterweight is raised during lowering of the door. The door can also be moved automatically into the raised position up to a specific cargo load by the force accumulator so that the user only has to apply force when the door is drawn down from the raised position into a lowered position, which simplifies the handling, since lowering is easier than raising. The force assistance can be used not only to raise the door into the raised position but rather also to move the door from the raised position into the closed position by a self-retracting device acting on the door, for example.

In a further embodiment, the force accumulator for pre-tensioning the door in a raised position is settable with respect to the force. Weight forces which result from the door weight and/or the cargo load can thus be compensated for. Different door dimensions and/or tolerance-related deviating spring forces may thus also be compensated for to finally move the door into an equilibrium or keep it in equilibrium, respectively. For this purpose, corresponding control elements can be provided on the force accumulator, wherein the force accumulator is designed, for example, as a spring assembly or spring, in particular as a compression spring. Alternatively or additionally, a guide path can be adjusted in the position to change a guide element, in particular a guide roller which is movable along the guide path and is pre-tensioned by the force accumulator toward the guide path, with respect to the acting force.

For a particularly efficient utilization of the interior of a cupboard or household appliance, a bottom panel and at least one shelf can be arranged in the body in a lower region, while a receptacle for the holder on the door is formed in an upper region. An access for the user is usually possible in the lower region, in particular if the cupboard is used as a wall unit in a kitchen. A bottom panel and at least one shelf can then be used to store objects which are made accessible after the opening of the door as in the case of known items of furniture. Instead of shelves, a receptacle for one or more holders, which are then moved together with the door, can only be provided in an upper region, for example, from a height above 1.80 m. The holder can be formed in this case as a shell, basket, hook, or holding bracket, wherein all devices for holding and storing objects can be fixed on the door.

The pivot device for the door may comprise at least two hinges spaced apart from one another in the vertical direction. The hinges can be formed in this case as single-joint or multi-joint hinges, for example, four-joint hinges or seven-joint hinges. A combination of linearly acting mechanisms and rotating mechanisms for pivoting the door are also usable. The hinges spaced apart from one another can alternately be secured fixed on the door or the body and can be secured movably on a carriage, which is movable along a guide rail, on the respective other part.

By way of a combined arrangement of pivot device and linear guide, opening and lowering of the door can run in a continuous movement sequence without the user having to take his operating hand from the operating handle and grasp again. A fast access to objects stored in the holder is thus also enabled.

In a further embodiment, a locking or latching device is provided, by means of which the door is lockable in a lowered position. Such latching or locking devices can be formed by mechanical catch elements, such as catch hooks, which hold the door in the lowered position against the force of a force accumulator in a predetermined position so that the user can release the door and it does not automatically move upward again. Instead of mechanical catch means, control means can also be used, which ensure a fixation of the door in the lowered position via button press, for example.

The pivoting of the door from an open position into a closed position can also take place completely or at least partially optionally via a self-retractor, which comprises a force accumulator to pre-tension the door mechanically in a closed position and thus is able to carry out a closing movement automatically. Instead of a self-retractor, an electrical drive can also be provided for closing the door.

In the method according to the disclosure, firstly a door is pivoted from a closed position in the horizontal direction into a first open position relative to a body. Subsequently, the door is lowered from the first open position into a second open position, wherein the second open position is arranged below the first open position and enables access to objects which are provided on a holder in the upper region of the door. The door can thus be raised from the second open position back into the first open position again and then pivoted from the first open position into the closed position. The movements of the door can optionally be carried out solely manually and are optionally assisted by one or more force accumulators. A force accumulator can be provided for raising the door, by means of which the door is moved automatically from the second open position into the first open position. A self-retractor can optionally also be provided, by means of which the door is moved automatically from the first open position into the closed position to simplify the handling. For this purpose, a damping device can furthermore optionally also be connected to enable damped closing of the door shortly before reaching the closed position.

Figure 1:
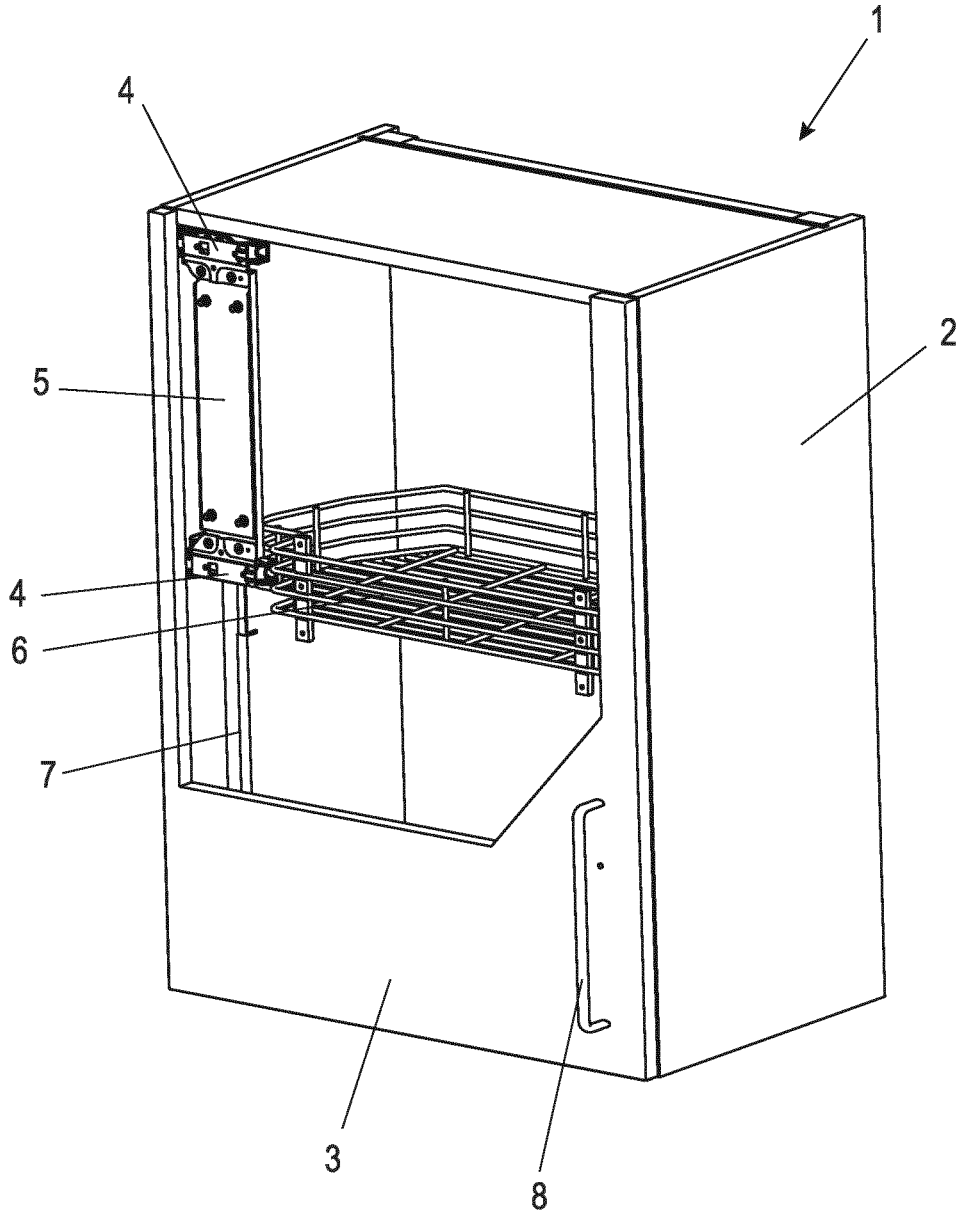
FIG. 1 shows a perspective view of a cupboard according to the invention with a portion of a door omitted for clarity.

A cupboard 1 comprises a body 2, which can be installed, for example, as a wall unit in a kitchen. Alternatively, the body 2 can also be used as a household appliance, for example, a refrigerator. A door 3 is pivotably mounted on the body 2, wherein the door 3 is formed plate-shaped and comprises a handle element 8 on the outer side. A pivot device having two hinges 4, between which a bracket 5 is provided, is secured on the door 3. A holder 6 in the form of a basket or a grating, which is used for storing objects, is provided on the inner side on the door 3. One or more of these holders 6, which can be moved together with the door 3, can be provided on the door 3 in the upper region, i.e., in the upper half of the door. In a lower region of the body 2, objects can be placed on a bottom panel or a shelf (not shown) on the body 2, since the lower region is also accessible by the user when standing.

Figure 2:
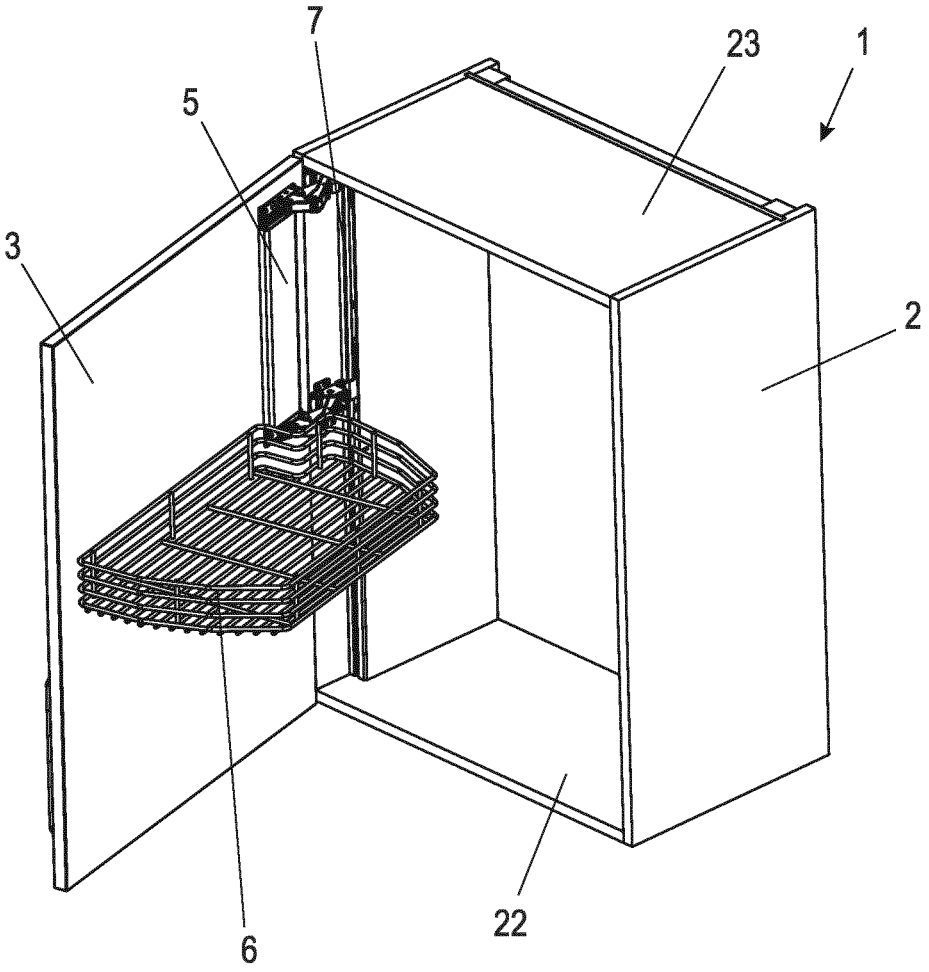
FIG. 2 shows a perspective view of the cupboard of FIG. 1 having the door in a first open position.
Figure 3:
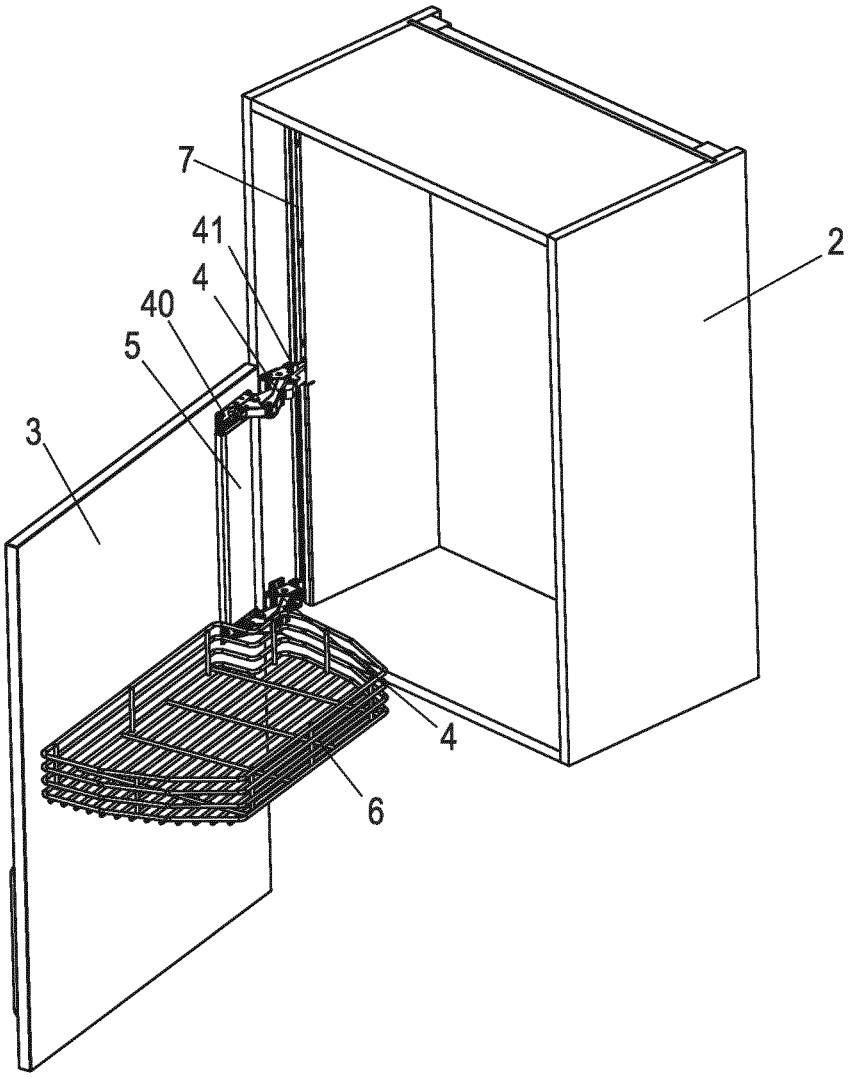
FIG. 3 shows a perspective view of the cupboard of FIG. 1 having the door in a second, lowered open position.

In FIG. 2, the door 3 was pivoted horizontally from the closed position into an open position, i.e., substantially around a vertical axis, wherein the pivot movement does not have to be executed exactly as a rotational movement, but rather can also be a superposition of a rotational movement with a horizontal sliding movement. In the open position of the door 3, a lower region of the body 2 having the bottom panel 22 is accessible. If objects are to be taken out of the holder 6 or introduced, the door 3 can be lowered, as shown in FIG. 3. For this purpose the two hinges 4 spaced apart from one another are vertically displaced along a guide rail 7 so that the door 3 is moved from the raised position shown in FIG. 2 into the lowered position shown in FIG. 3, so that the holder 6 is better accessible to the user. The sliding movement in the vertical direction along the guide rail 7 can be, for example, between 20 cm and 80 cm. To close the door 3, it can again be raised along the guide rail 7 and then pivoted from the open position into the closed position.

Figure 4:
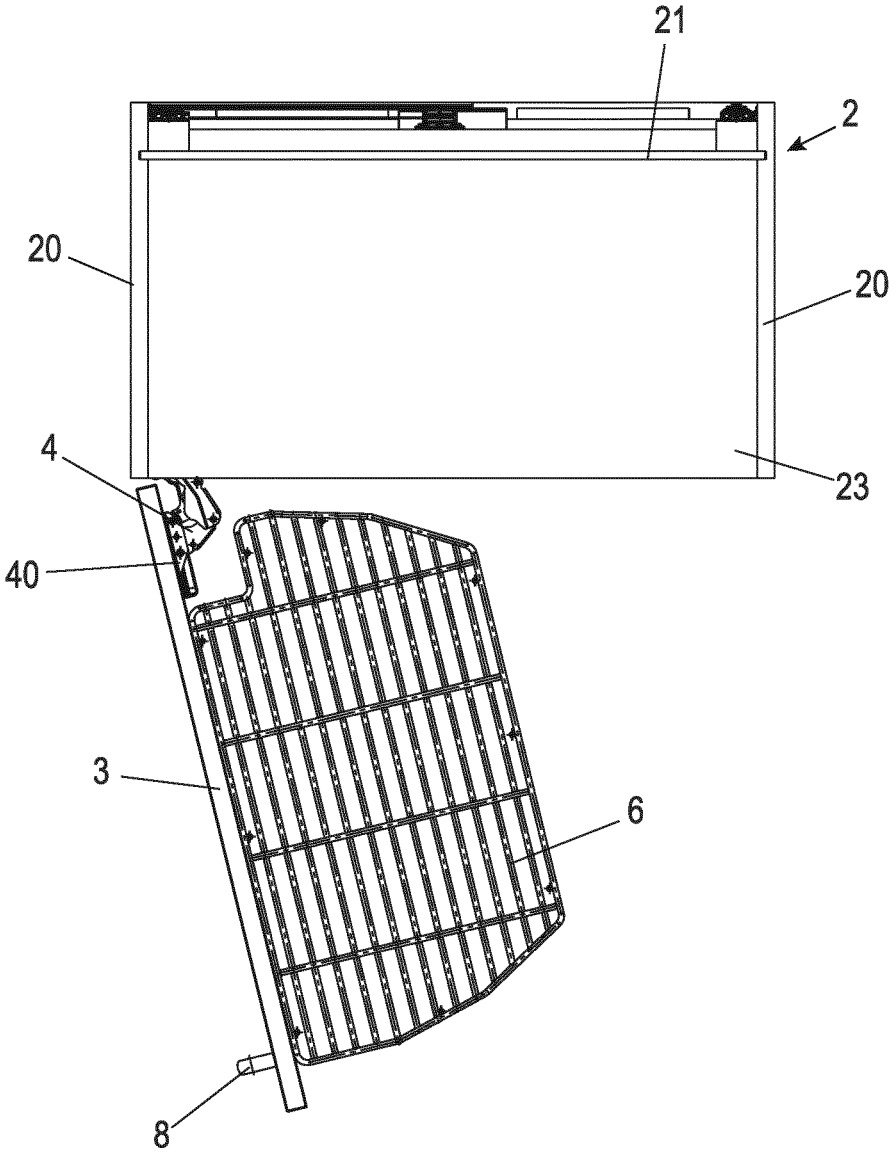
FIG. 4 shows a top view of the cupboard of FIG. 3.

A top view of the cupboard 1 having an open door 3 is shown in FIG. 4. It is recognizable that the holder 6 is moved together with the door 3 and lowering of the door 3 can only take place if the holder 6 is arranged completely outside the body 2, in order to avoid a collision with the bottom panel 22, objects placed thereon, or a shelf (not shown).

In addition to the bottom panel 22, the body 2 also comprises a top panel 23, which is arranged between two side walls 20. The side walls 20 and the bottom panel 22 and top panel 23 are connected to one another on the rear side by a rear wall 21, which is installed spaced apart from a rear-side front edge of the side walls 20, to provide a space for components behind the rear wall 21, for example, for a force accumulator.

Figure 5:
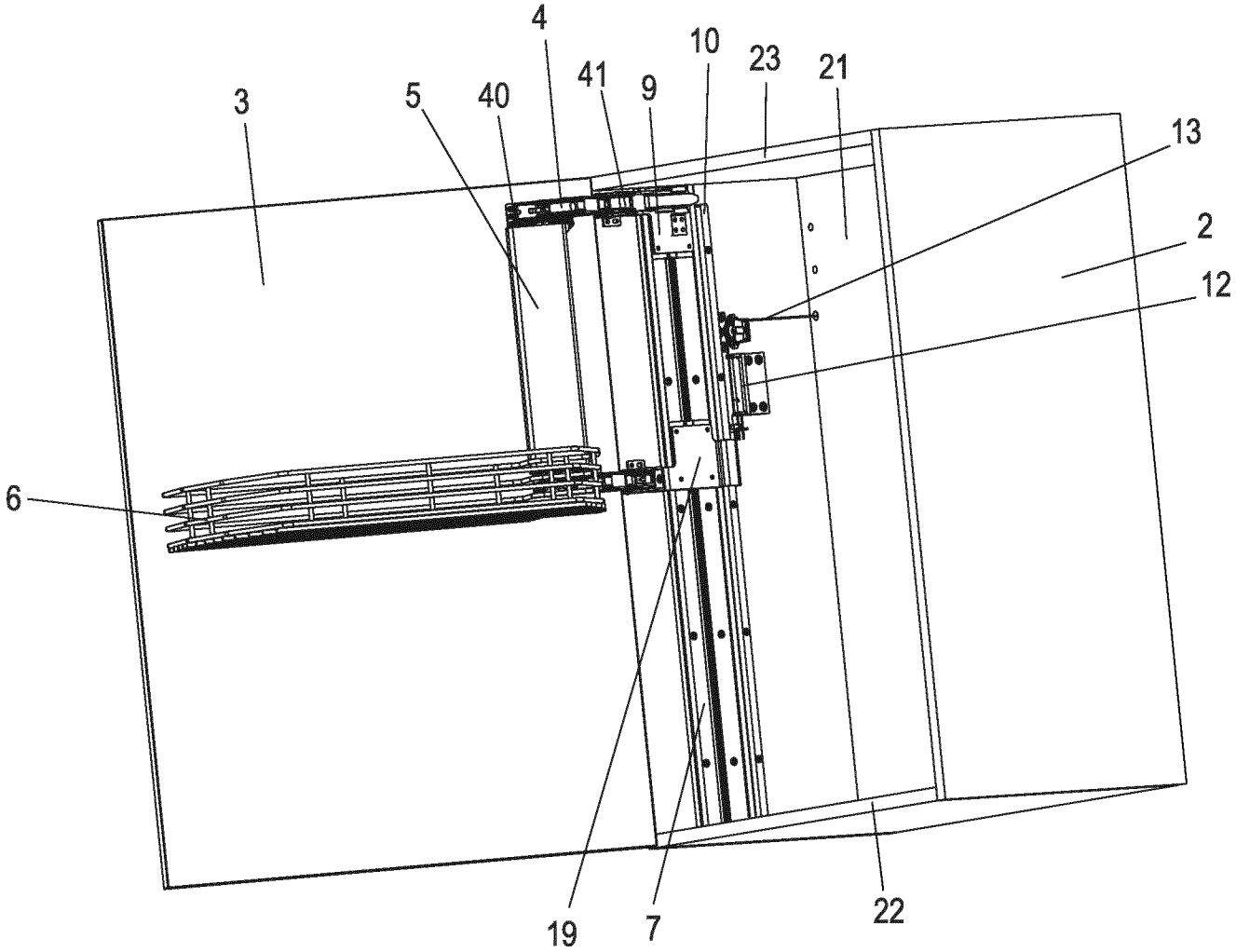
FIG. 5 shows a perspective view of the cupboard of FIG. 2.

In FIG. 5, the door 3 is shown in an open position, and the two hinges 4 are recognizable, which are secured on the door 3 using a hinge part 40 in the illustrated exemplary embodiment. A second hinge part 41, which is pivotable relative to the hinge part 40, is fixed on an upper carriage 9 and a lower carriage 19, which are movable along a guide rail 7 in the vertical direction. The guide rail 7 is secured in this case in a front region on a side wall 20 of the body 2. It is also possible to provide only one carriage instead of two carriages 9 and 19. A blocking bracket 10 is arranged adjacent to the guide rail 7, which prevents the door 3 from being pivoted in the closing direction in a lowered position. As soon as the door 3 is moved downward in the vertical direction out of the position shown in FIG. 5, it may only be pivoted up to a predetermined opening angle in the closing direction to avoid a collision of the holder 6 with objects in the body 2, a shelf, or the bottom panel 22.

Figure 6:
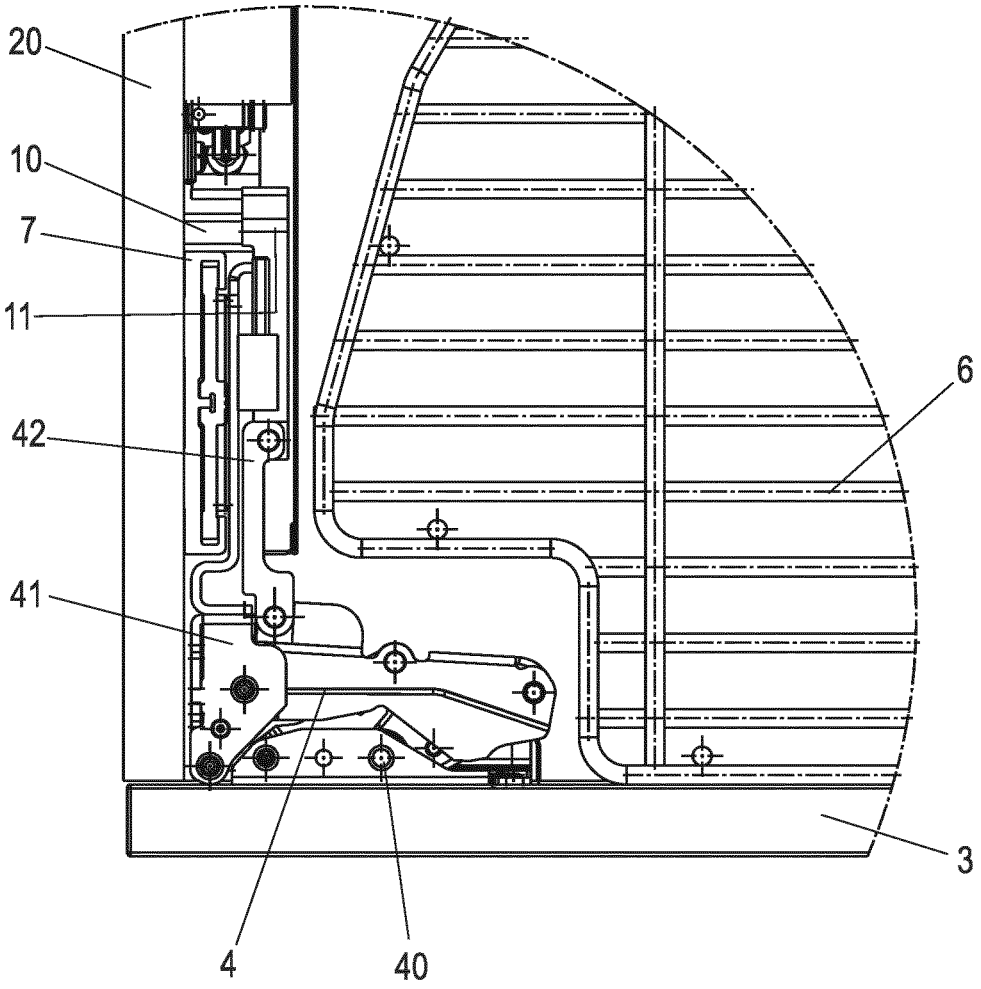
FIG. 6 shows a top view of the pivot device of the cupboard of FIG. 1 in a closed position.
Figure 7:
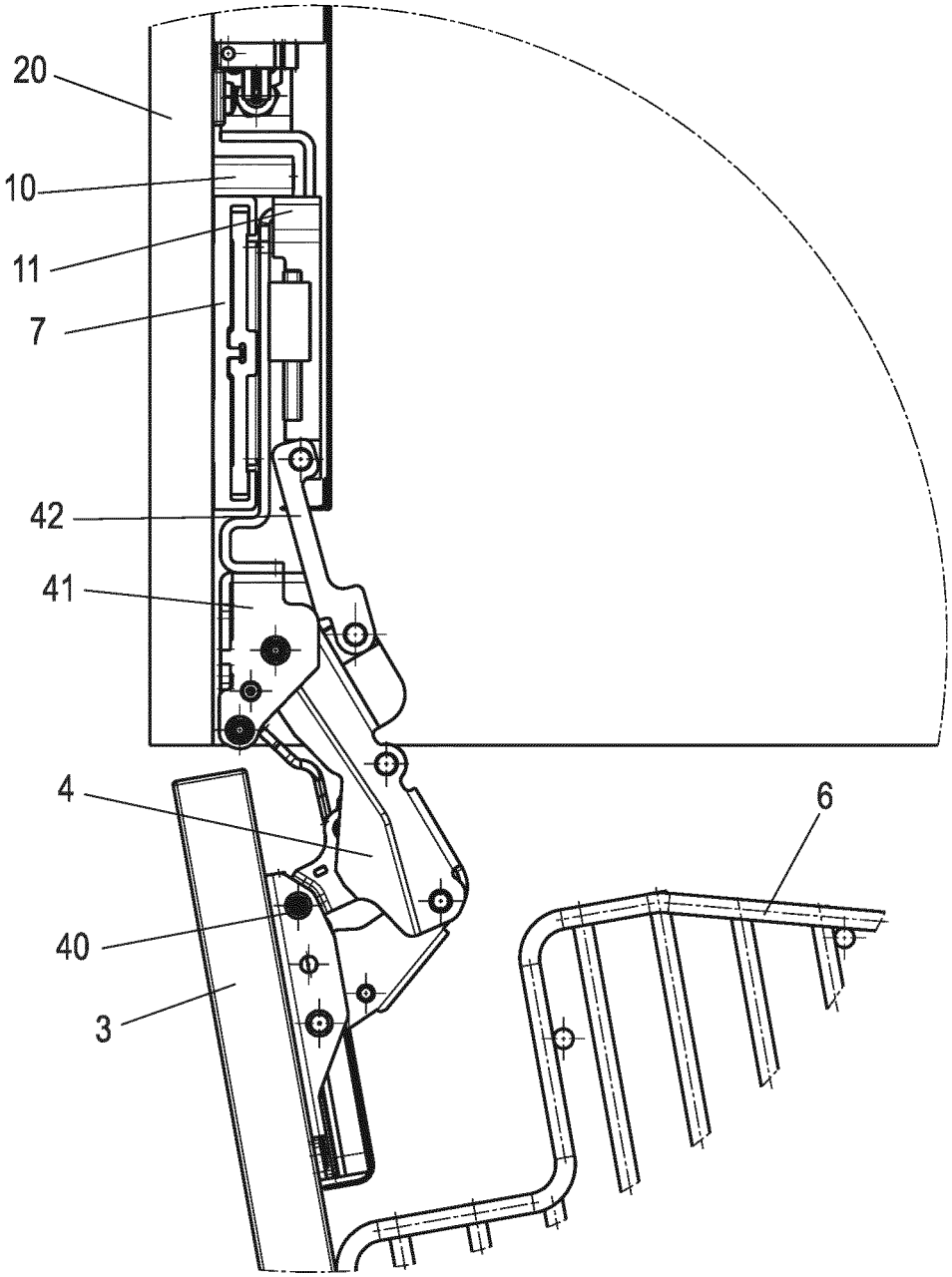
FIG. 7 shows a detail view of the pivot device according to FIG. 6 in a first open position.
Figure 8:
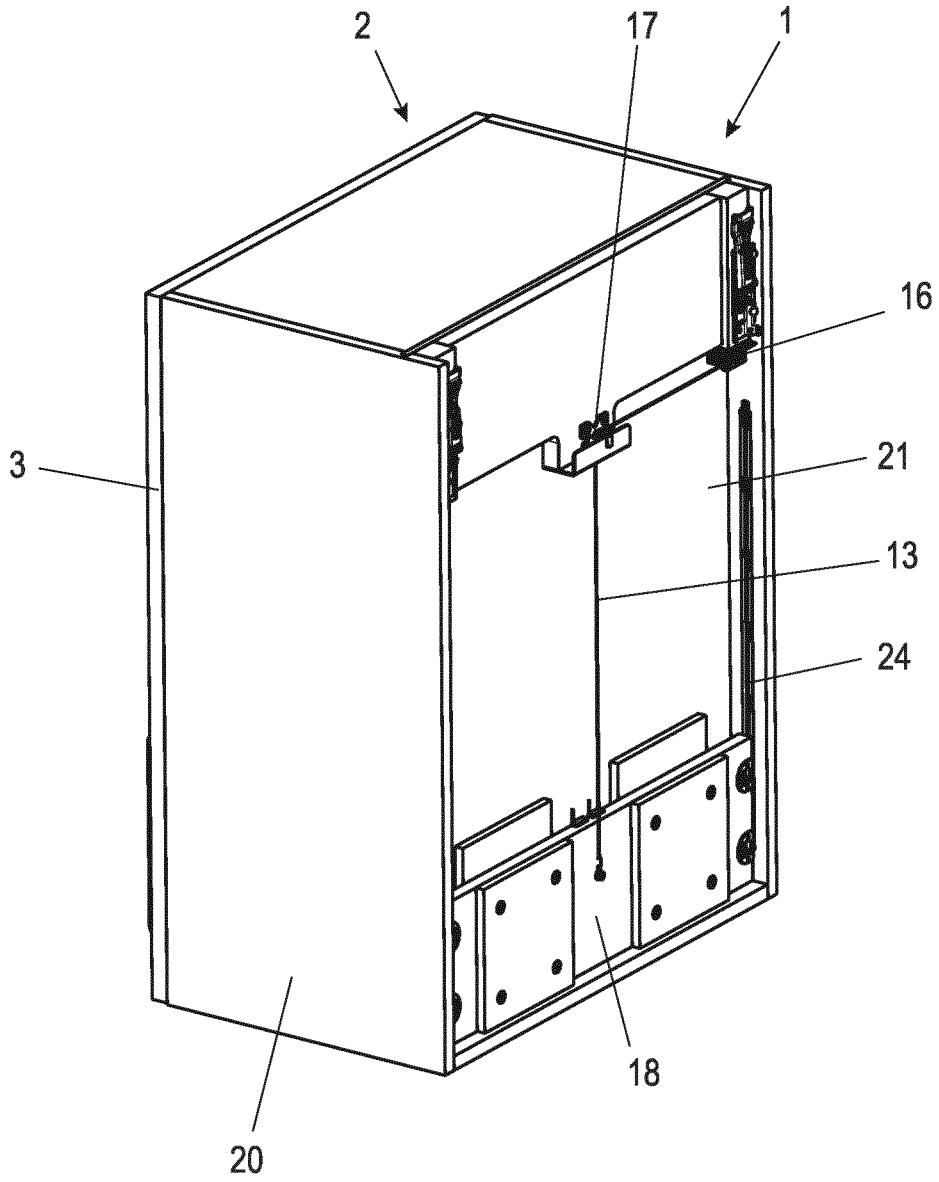
FIG. 8 shows a perspective view of the cupboard of FIG. 1 from the rear.

The function of the blocking device for the door 3 will be explained in greater detail with reference to FIGS. 6 and 7. In FIG. 6, the door 3 is shown in a closed position, and a lever 11 is located above an end face of the blocking bracket 10, so that lowering of the door 3 into the closed position and an opening range between the closed position and a first open position is prevented. The end face of the blocking bracket 10 forms a stop for the lever 11. If the door 3 is now opened from the closed position into a first open position, as shown in FIG. 7, the hinge part 40 pivots relative to the hinge part 41 and pulls the lever 11 parallel to the side wall 20 via a drag lever 42 until an end face of the blocking bracket 10 is no longer overlapped by the lever 11. The blocking device is thus released from the end face of the blocking bracket 10 and the lever 11, which takes place, for example, in an angle range from 70° spaced apart from the closed position, so that lowering of the door 3 is first enabled when the door 3 is opened from the closed position by approximately 70°. The user can thus lower the door 3 by pulling on the handle element 8, by the pivot device being moved with the hinges 4 along the guide rail 7. The blocking bracket 10 extends over the entire movement path of the door 3 downward so that a front side of the blocking bracket forms a second blocking device, which prevents the door 3 from being pivoted in the closing direction in a lowered position. As FIG. 7 shows, during lowering of the lever 11, it can be moved along a front side of the blocking bracket 10, wherein the door 3 is prevented from moving further in the closing direction from the illustrated position. The door 3 can thus only be moved downward in a specific opening range, for example, proceeding from 50° up to the maximally open position, which can be, for example, in a range between 80° and 110°, for example, at 70°. The door 3 can only be moved back in the closing direction in a raised position, in which the lever 11 is moved beyond an upper end face of the blocking bracket 10. In this case, the end face of the blocking bracket 10 can also be formed inclined to cause a slight raising of the door 3 during the closing.

Figure 9:
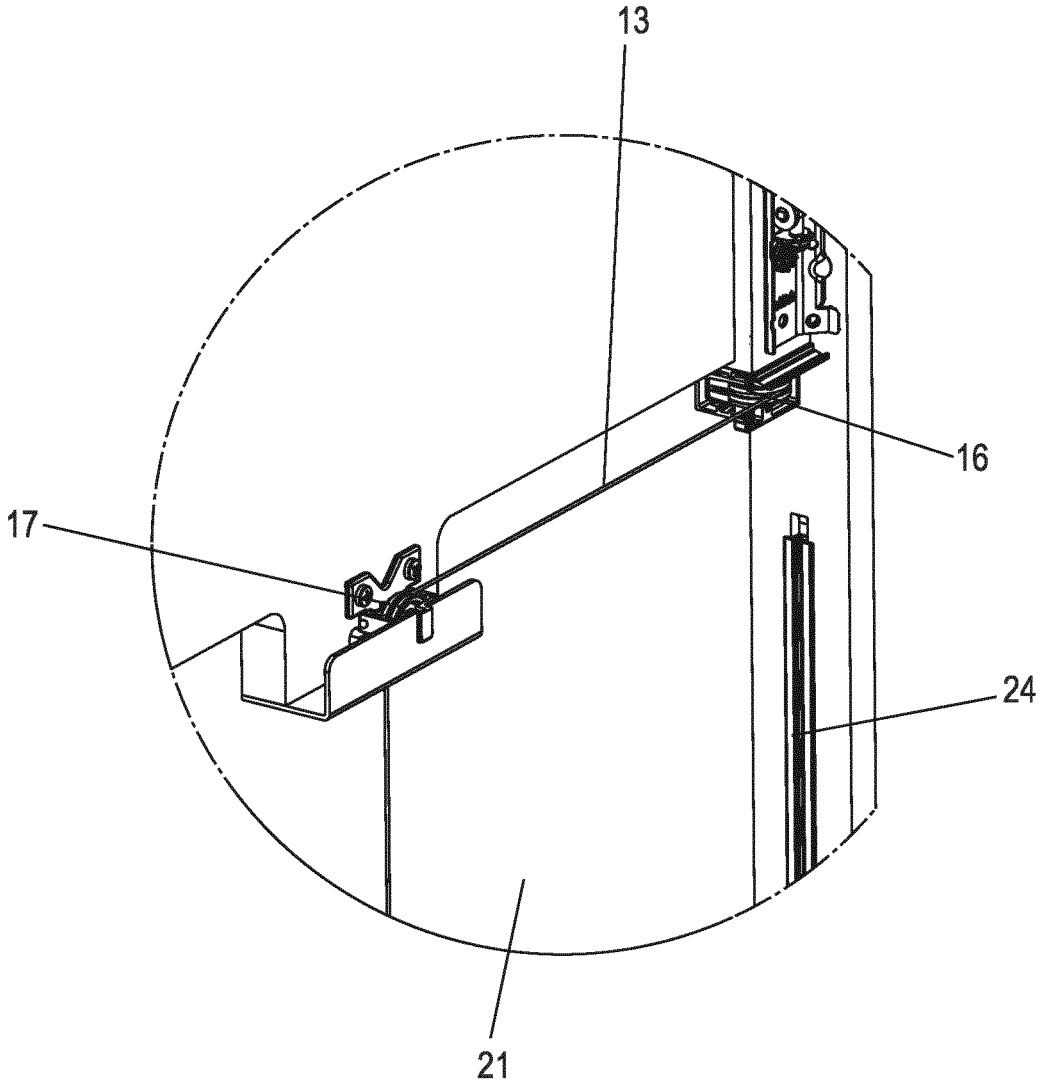
FIGS. 9 and 10 show two detail views of the pull cable for the force accumulator for raising the door.

The door 3 of the cupboard 1 is pre-tensioned in a raised position. For this purpose, a counterweight 18, which is movable via a cable pull 13, is arranged behind the rear wall 21. The counterweight 18 is guided on the rear side of the body 2 along rails 24, which are provided on opposing side walls 20. Furthermore, the counterweight 18 is suspended in the middle on the cable pull 13, wherein the cable pull 13 is guided on the rear side via a first deflection roller 16 and a second deflection roller 17, which are rotatably mounted on holders (FIG. 9).

Figure 10:
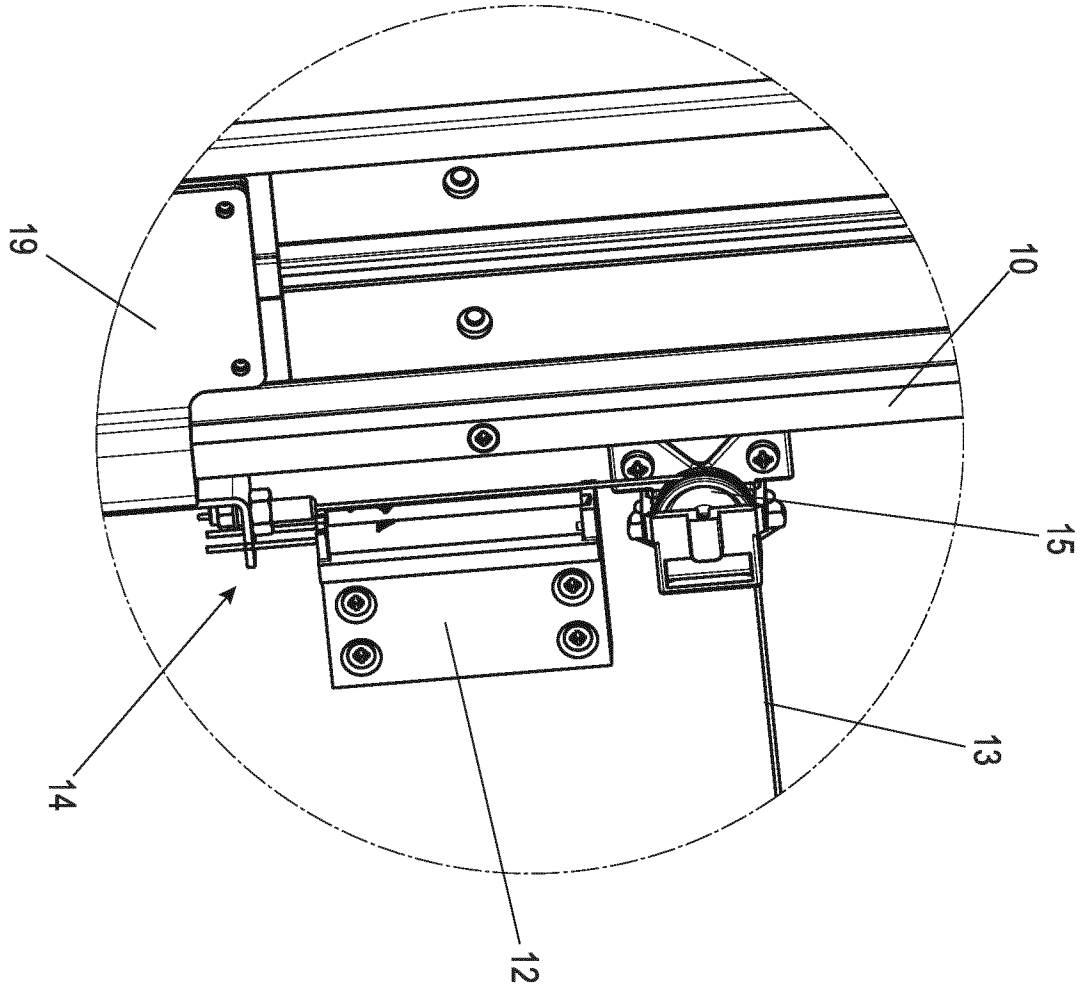

As FIG. 10 shows in conjunction with FIG. 5, the cable pull 13 is guided by the rear wall 21, deflected via a further deflection roller 15, and fixed on a fastening element 14, which is arranged on the carriage 19. During the lowering of the door 3, the counterweight 18 is thus raised via the cable pull 13, so that the counterweight 18 forms a force accumulator, which pre-tensions the door 3 in the raised position. The length of the cable pull 13 can be set via an adjustment device. Moreover, a stop is provided on the carriage 19, which interacts with a stop element 12, so that raising of the door 3 only takes place up to the stop in order to be able to pivot the door 3 in the closing direction in the stop position. The stop can also be formed adjustable here to be able to perform an adjustment of the stop position.

Instead of the formation of the force accumulator by a counterweight 18, of course, other spring elements can also be used, in particular gas pressure springs, coiled springs, or other spring devices, to pre-tension the door 3 upward. The pre-tensioning of the door 3 can be selected, for example, so that loading of the door 3 with a weight of up to 10 kg is possible and the door 3 is still pre-tensioned upward. The door 3 can thus also be moved automatically via the force accumulator from the lowered position into a raised position. Before reaching a stop, a damping device can moreover be provided to avoid a loud impact during a vertical movement upward.

Figure 11A:
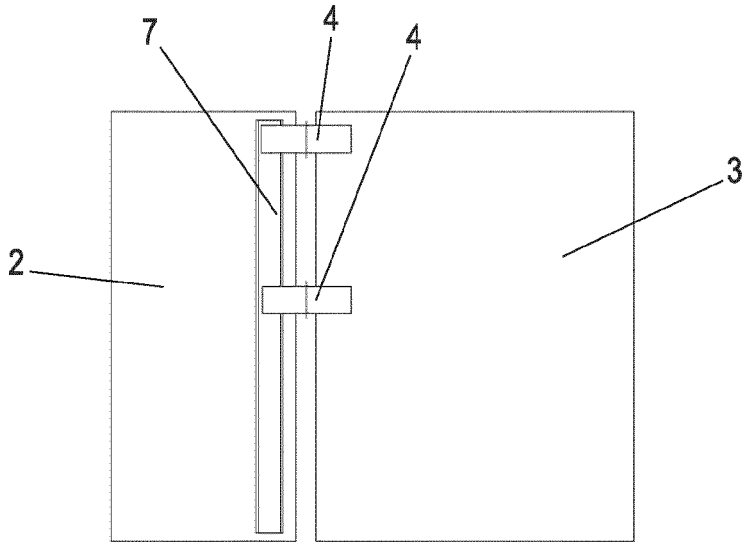
FIGS. 11A and 11B show two schematic views of the functional principle of the first exemplary embodiment.
Figure 11B:
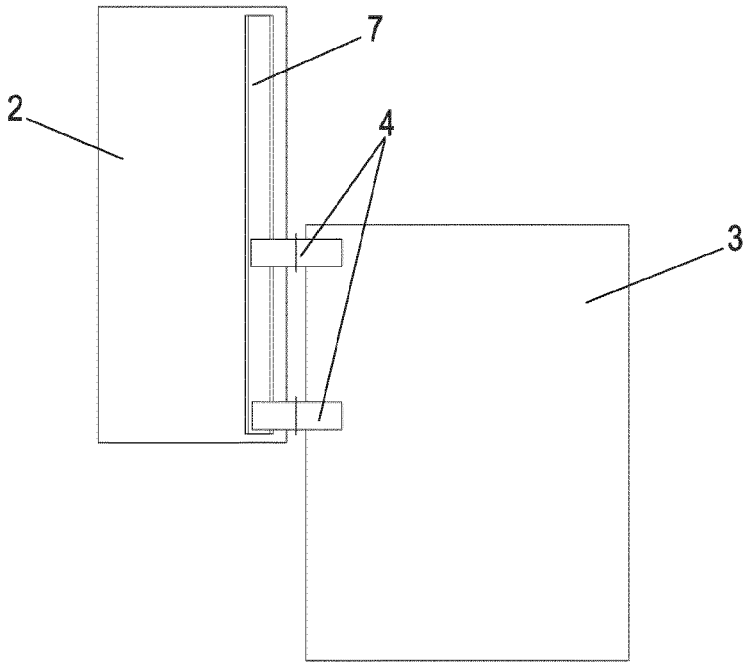

The functional principle of the cupboard 1 of the exemplary embodiment of FIGS. 1 to 10 is schematically shown in FIGS. 11A and 11B. A guide rail 7, along which two hinges 4 are held movably, is provided on the body 2. The hinges 4 enable pivoting open of the door 3 in the horizontal direction from a closed position into a first open position. From this first open position, which is in an opening range between 70° and 110°, for example, the door 3 can then be lowered, as shown in FIG. 11B. In the lowered position, objects can then be removed or introduced on the holder 6, after which the door 3 is then moved back from the lowered second open position into the first upper open position, from which it is moved into the closed position by pivoting the door 3.

Figure 12A:
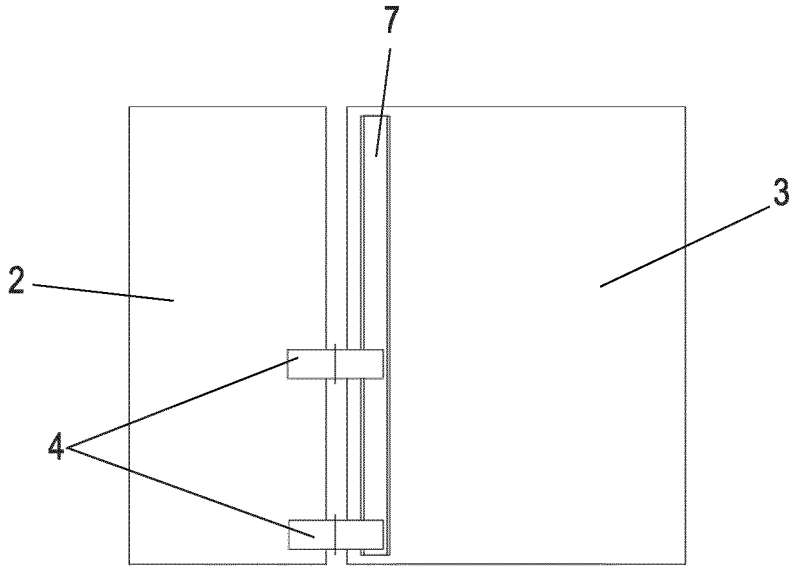
FIGS. 12A and 12B show two schematic views of the functional principle of a second exemplary embodiment.
Figure 12B:
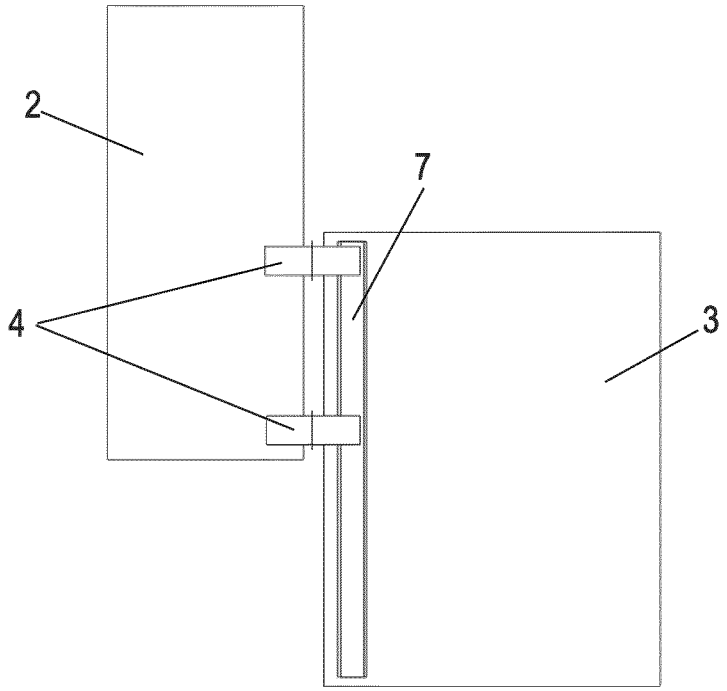

As shown in FIGS. 12A and 12B, the guide rail 7 can also be arranged on the door 3 instead of on the body 2. The two hinges 4 are then secured on a side wall of the body 2 and are not moved in the vertical direction. Rather, the guide rail 7 is moved together with the door 3, as FIGS. 12A and 12B show. Otherwise, the method for opening and closing the door 3 takes place as in the preceding exemplary embodiment.

Figure 13A:
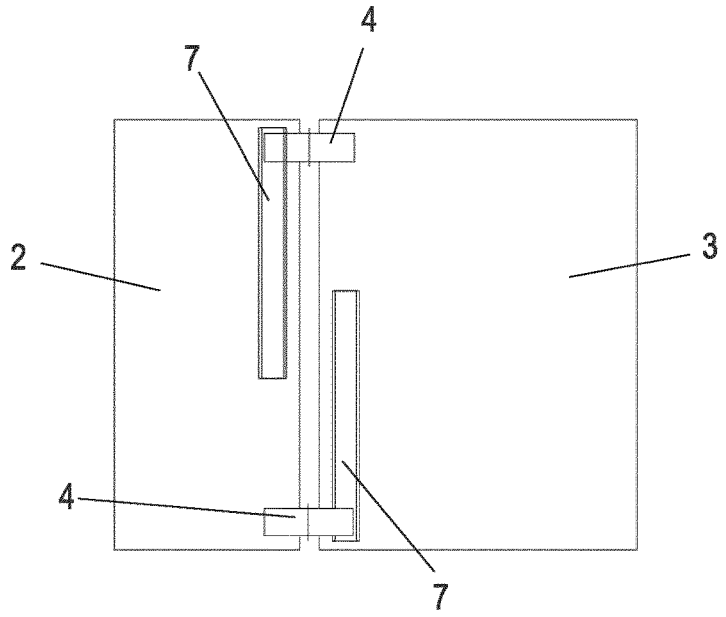
FIGS. 13A and 13B show two schematic views of the functional principle of a third exemplary embodiment.
Figure 13B:
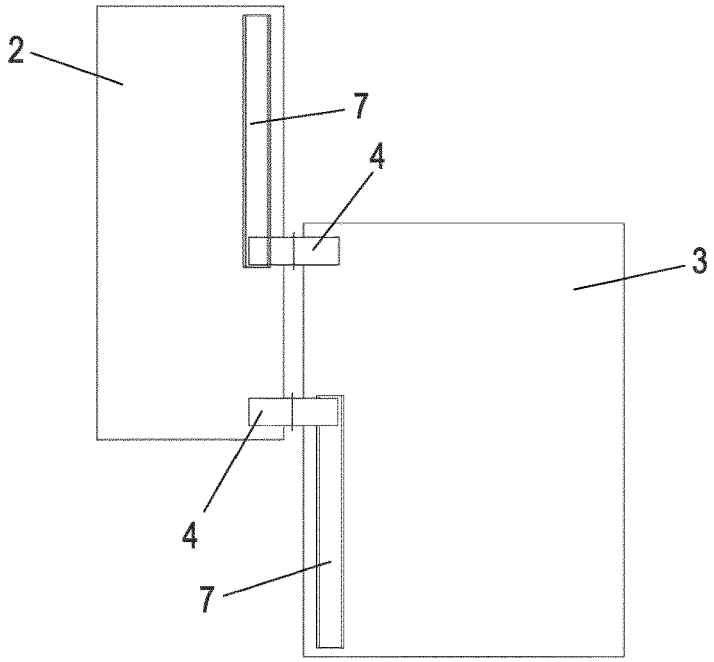

A further exemplary embodiment of a cupboard is shown in FIGS. 13A and 13B, in which a first guide rail 7 for at least one hinge 4 is provided on a body 2, and in addition a second guide rail 7 for at least one further hinge 4 is provided on the door 3. When the door 3 has been pivoted via the hinges 4 into the first open position, the door can subsequently be lowered, as shown in FIG. 13B. During the lowering of the door 3, the at least one upper hinge 4 moves along the guide rail 7 secured on the body 2, and the lower guide rail 7 moves vertically in relation to the lower hinge 4, which is arranged in a stationary manner. The solution shown in FIGS. 13A and 13B has the advantage that due to the greater spacing of the hinges 4 in the first open position, the lever ratios are better, even if the construction expenditure is slightly increased by the arrangement of two guide rails 7.

Figure 14A:
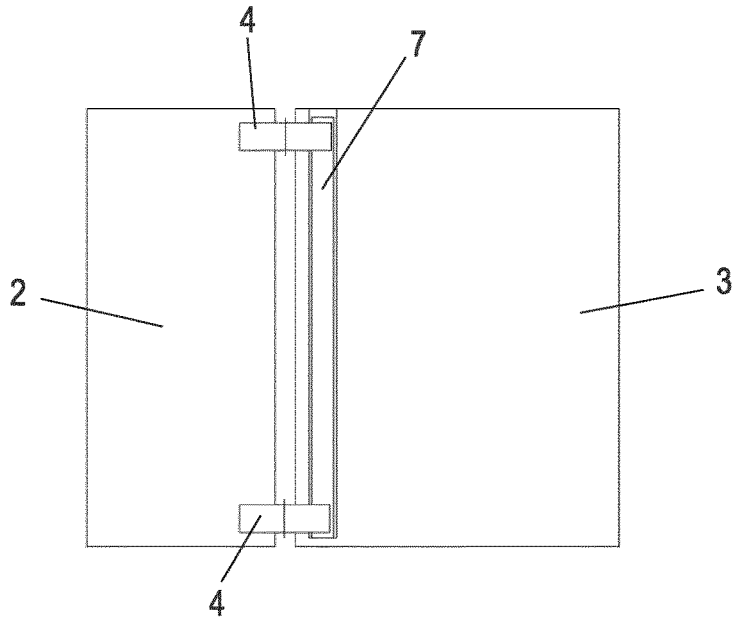
FIGS. 14A and 14B show two schematic views of the functional principle of a fourth exemplary embodiment.
Figure 14B:
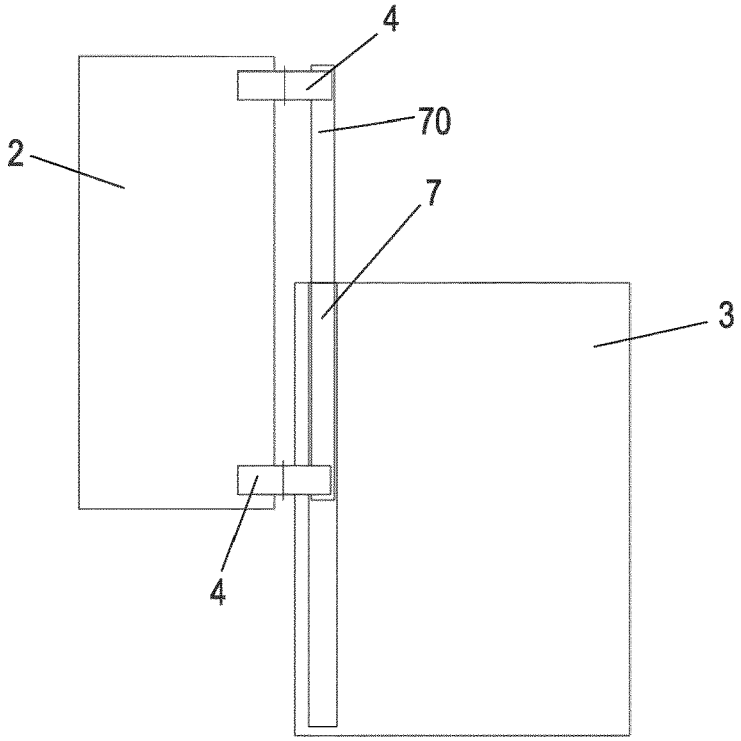

A further embodiment of a body 2 is shown in FIGS. 14A and 14B, on which a door 3 can be pivoted into a first open position, to then lower it. In this exemplary embodiment, two hinges 4 are provided, which are secured on the body 2. If the door 3 is now lowered from the raised position into the lowered position of FIG. 14B, the hinges 4 remain fixed in place on the body 2, and a stationary rail 70 remains on the upper hinge 4. The guide rail 7 is moved downward together with the door 3 in relation to the stationary rail 70. The guide rail 7 and the further rail 70 thus form a pullout guide, which can comprise two or three rails, which are held so they are movable on one another via roller bodies or rollers. The greater spacing of the hinges 4 on the body 2 also has a positive effect on the lever ratios in this embodiment.

In the schematic illustrations of the exemplary embodiments of FIGS. 11 to 14, as in the first exemplary embodiment, a force accumulator for raising the door 3, pre-tensioning the door 3 in a raised position, a blocking device for preventing the lowering of the door 3 in a closing range, and a further blocking device for preventing the movement of the door 3 in the closing direction in a lowered position can be provided.

Figure 15A:
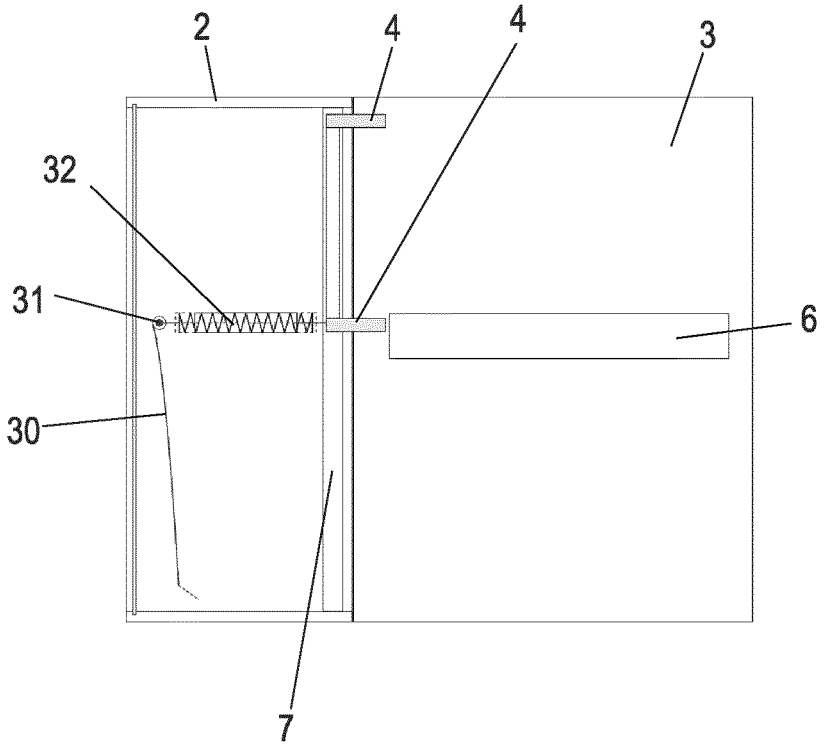
FIGS. 15A to 15C show multiple schematic views of a further exemplary embodiment having modified force accumulator.
Figure 15B:
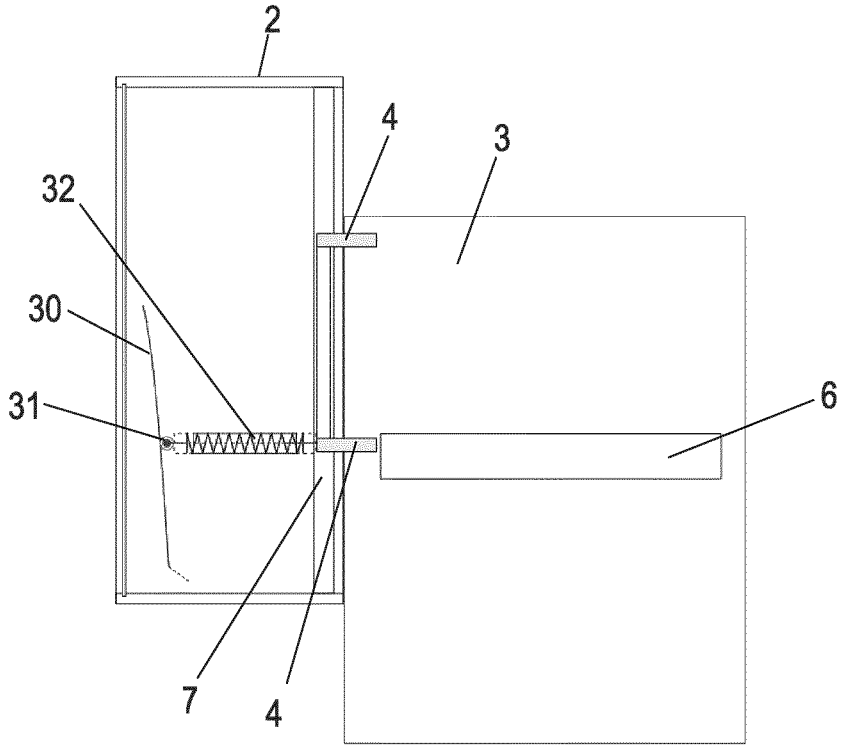
Figure 15C:
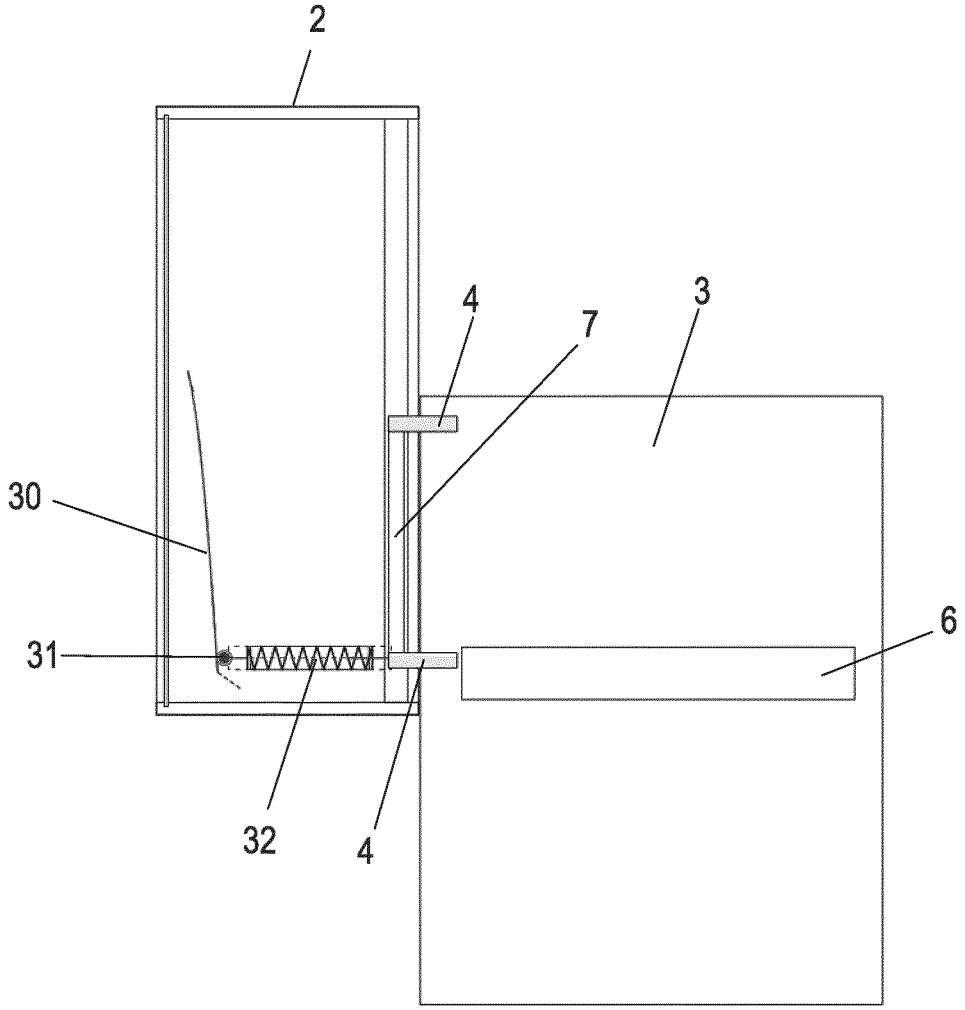

A further exemplary embodiment of a force accumulator is shown in FIGS. 15A to 15C in order to pre-tension the door 3 in a raised position. The schematically illustrated force accumulator comprises a guide path 30, which is secured, for example, on one or both inner sides of the side walls 20 of the body 2. A guide roller 31 rolls along the guide path 30, to which force is applied by a spring 32, which is supported at the end in the region of the lower hinge 4, so that during a movement of the door 3 from a raised position according to FIG. 15A into a slightly lowered position according to FIG. 15B, the guide roller 31 is moved along the guide path 30 and the spring 32 is thus compressed. The spring 32 is compressed more strongly by further lowering, as shown in FIG. 15C. The spring 32 relaxes again during the raising of the door 3, so that spring forces are released. The arrangement of such a spring 32 has the advantage that in the lowered position according to FIG. 15C, a catch receptacle can be provided on the guide path 30, so that the door 3 can be latched in a lowered position. The user can thus latch the door 3 and then remove or introduce objects from or to the holder 6 with both hands. Such a catch device can be used in all illustrated exemplary embodiments to be able to release the door 3 in a lowered position without the door 3 raising again. Instead of latching, a locking device can also be used, which blocks raising of the door 3. Such latching or locking devices can be formed using mechanical elements, such as catch hooks, catch receptacles, locking bolts, etc., and the position of the catch device can be selected variably within the body 2.

Figure 16A:
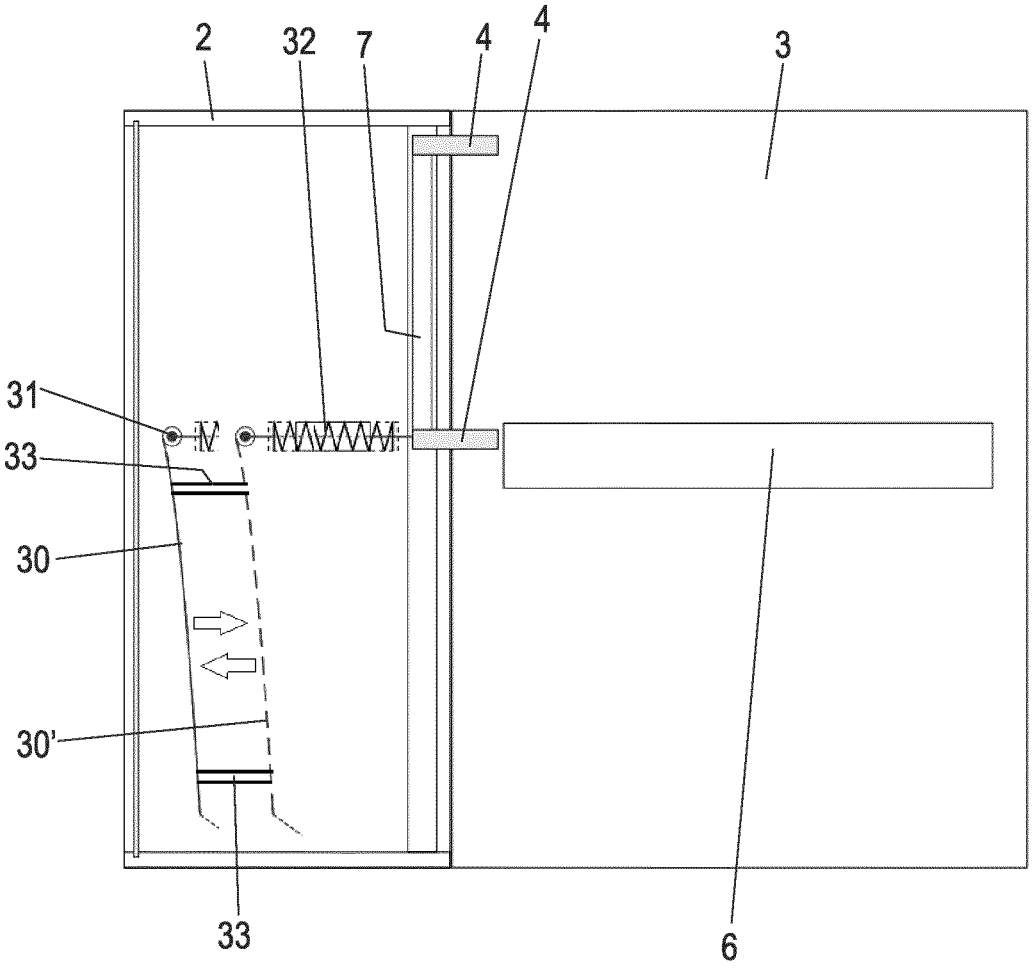
FIGS. 16A and 16B show two views having embodiments of the setting of the force for raising the door.

In FIG. 16A, the embodiment of FIG. 15 is modified in such a manner that the guide path 30 is arranged so it is adjustable in order to set the force of the force accumulator in the form of a spring 32 for raising the door 3 in relation to the body 2. For this purpose, the guide path 30 is movable along two linear positioning elements 33 in the horizontal direction in order to be moved, for example, from this first position having solid lines into a position in which the guide path 30' is shown by dashed lines. The spring 32 is thus compressed, and higher forces act for raising the door 3. The linear positioning element is preferably formed as a linear guide. The adjustment can take place continuously in order to compress or relax the spring 32.

Figure 16B:
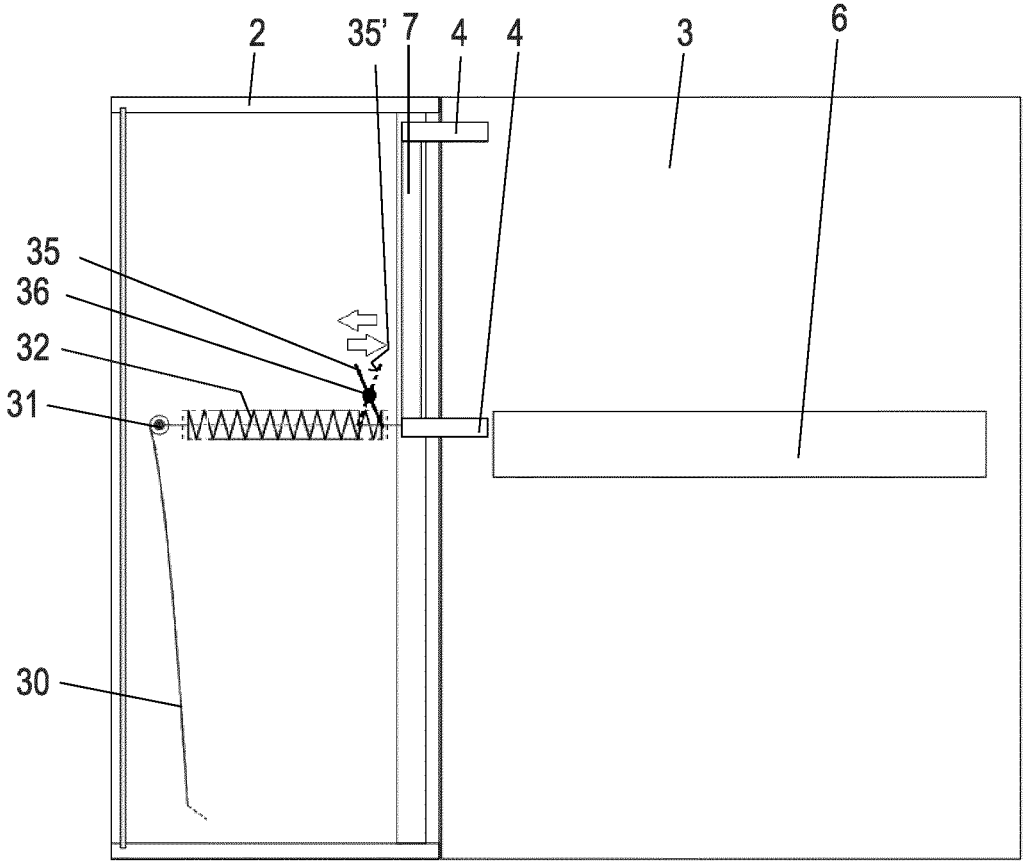

An alternative embodiment is shown in FIG. 16B, to be able to set the force of the spring 32 for raising the door. Instead of the adjustment of the guide path 30, a switchover element 35 is provided, for example, a pivotable lever or a slide, which compresses or relaxes the spring 32. For this purpose, the switchover element 35 can be transferred via a pivot axis 36 into the position of the switchover element 35' shown by dashed lines. Other adjustment mechanisms, for example, screw gears, coupling gears, curve gears, or the like can also be provided for changing the force of the spring 32 for setting the pre-tension for raising the door 3. Moreover, the two embodiments of FIGS. 16A and 16B can also be combined with one another.

Furthermore, a self-retractor can be provided in the illustrated exemplary embodiments, by means of which the door 3 is pivoted from the first open position, in which it is raised, into a closed position. Such a self-retractor can comprise a force accumulator, in particular a spring, which moves the door 3 from the first open position automatically into the closed position. To avoid impact noises, a damper can be provided before reaching the closed position, to enable automatic movement of the door 3 without loud noises. In addition to the self-retractor, the force accumulator for raising the door 3 can be used to enable an automatic movement of the door 3 into the raised first open position to then automatically effectuate pivoting of the door 3 into the closed position. The user can then pivot the door 3 from a lowered position, which has to be unlocked or unlatched, however, automatically into the raised position and then in the raised position into the closed position.

In the illustrated exemplary embodiments, the door 3 is mechanically pre-tensioned by a force accumulator. Of course, it is also possible to provide a drive for the corresponding movements, in particular an electromotive drive. A corresponding movement can be generated, for example, via a spindle, on which a spindle nut is moved, which is secured using a structural unit on the body 2 or the door 3. Other drive devices can also be used.

The invention claimed is:

1. A cupboard or household appliance having a body on which a door is pivotable about a vertical axis via a pivot device from a closed position into an open position, wherein at least one holder for storing objects is fixed on an inner side of the door facing toward the body, wherein the door is lowerable in a vertical direction along a guide device into an opening range of the door, wherein the guide device is a linear guide comprising a plurality of rails movable with respect to each other, wherein the door is pre-tensioned via a force accumulator in a raised position, and wherein the force accumulator is a spring and setting means are provided for changing the pre-tension of the spring.

2. The cupboard or household appliance according to claim 1, wherein a first blocking device is provided, which prevents lowering of the door in a closing range of the door.

3. The cupboard or household appliance according to claim 2, wherein the first blocking device is active at least in a closing range between the closed position and an opening angle of 60°.

4. The cupboard or household appliance according to claim 1, wherein a second blocking device is provided, which prevents pivoting of the door from an open position into a closing range if the door is arranged in a lowered position.

5. The cupboard or household appliance according to claim 1, wherein the force of the force accumulator provided for raising the door is settable.

6. The cupboard or household appliance according to claim 1, wherein a guide path, along which the guide roller or guide element pre-tensioned by the force accumulator is movable, is adjustable to set the force of the force accumulator.

7. The cupboard or household appliance according to claim 1, wherein a bottom panel and optionally at least one shelf are arranged in the body in a lower region and a free space for a receptacle for the holder is formed in an upper region.

8. The cupboard or household appliance according to claim 1, wherein the holder comprises a shell, a basket, a hook, and/or a holding bracket.

9. The cupboard or household appliance according to claim 1, wherein the guide device comprises a guide rail, on which a carriage is movably held.

10. The cupboard or household appliance according to claim 1, wherein the pivot device comprises at least two hinges arranged spaced apart from one another in the vertical direction.

11. The cupboard or household appliance according to claim 10, wherein the hinges are secured on the door and/or are movable on a carriage along a guide rail.

12. The cupboard or household appliance according to claim 1, wherein a locking or latching device is provided, by means of which the door can be latched or locked in a lowered position.

13. The cupboard or household appliance according to claim 1, wherein a self-retractor is provided, by means of which the door is pivotable from an open position into a closed position.

14. A cupboard or household appliance having a body on which a door is pivotable about a vertical axis via a pivot device from a closed position into an open position, wherein at least one holder for storing objects is fixed on an inner side of the door facing toward the body, wherein the door is lowerable in a vertical direction along a guide device into an opening range of the door, wherein the guide device is a linear guide comprising a plurality of rails movable with respect to each other, and wherein the body comprises a bottom shelf and wherein the door is lowerable so that at least a portion of the door extends below the bottom shelf.

* * * * *